US006626814B1

(12) United States Patent
Setterberg

(10) Patent No.: US 6,626,814 B1
(45) Date of Patent: Sep. 30, 2003

(54) DRIVE UNIT FOR A CENTRIFUGE ROTOR OF A CENTRIFUGAL SEPARATOR

(75) Inventor: Jan Setterberg, Huddinge (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/889,618

(22) PCT Filed: Mar. 8, 2000

(86) PCT No.: PCT/SE00/00459

§ 371 (c)(1),
(2), (4) Date: Jul. 17, 2001

(87) PCT Pub. No.: WO00/53328

PCT Pub. Date: Sep. 14, 2000

(30) Foreign Application Priority Data

Aug. 3, 1999 (SE) ..... 9900818

(51) Int. Cl.[7] ..... B04B 9/00
(52) U.S. Cl. ..... 494/15; 494/41; 494/84
(58) Field of Search ..... 494/15, 27–29, 494/41, 43, 83, 84; 210/360.1, 380.1

(56) References Cited

U.S. PATENT DOCUMENTS 1,649,346 A * 11/1927 Grimble et al.
2,281,797 A * 5/1942 Potter
2,387,276 A * 10/1945 Link
2,448,038 A * 8/1948 Lykken et al.
2,698,131 A * 12/1954 Cook
4,202,488 A * 5/1980 Jackson et al.
4,412,707 A * 11/1983 Buffet
4,654,023 A * 3/1987 Foldhazy
6,117,063 A * 9/2000 Szepessy et al.
6,228,016 B1 * 5/2001 Kristensen et al.

FOREIGN PATENT DOCUMENTS

EP 215585 * 3/1987
WO 96/23162 * 8/1996

* cited by examiner

*Primary Examiner*—Charles E. Cooley
(74) *Attorney, Agent, or Firm*—McCormick, Paulding & Huber LLP

(57) ABSTRACT

A drive unit for a centrifuge rotor of a centrifugal separator is provided that includes a drive shaft, arranged to support the centrifuge rotor and rotatably journalled around an axis (z) of rotation, a casing, which forms an inner space for the drive shaft, a drive motor shaft which is provided outside the casing and connected to the drive shaft by means of a transferring member extending through a passage in the casing, at least one shielding member, which is provided inside the casing in such a manner that the part of the transferring member which is located inside the casing is shielded from the inner space, and wherein the shielding member forms a channel, which extends through the casing and is shielded from the inner space of the casing.

9 Claims, 3 Drawing Sheets

DRIVE UNIT FOR A CENTRIFUGE ROTOR OF A CENTRIFUGAL SEPARATOR

FIELD OF THE PRESENT INVENTION

Background of the Present Invention

The present invention refers to a drive unit for a centrifuge rotor of a centrifugal separator, wherein the drive unit includes a drive shaft, which is arranged to support said centrifuge rotor and rotatably journalled around an axis of rotation in at least one first bearing member, a casing, which forms an inner space for the drive shaft and said bearing member, and a drive motor, which is provided outside the casing and connected to the drive shaft by means of a transferring member extending through a passage in the casing.

In order to cool the bearings supporting the drive shaft in such a drive unit, it is known to re-circulate an air stream which, by means of accompanying oil droplets, forms an oil mist through the bearings and the inner space defined by the casing. Such drive units frequently include a drive belt for transferring the rotation of the drive motor to the drive shaft of the centrifuge rotor. In the cases that the drive motor is located outside the casing, the drive belt will either engage the drive shaft beneath the casing or extend through an opening in the casing. In order to prevent, in the latter case, oil from penetrating the environment and contacting the drive belt, the opening has to be sealed with respect to the drive belt. It has proved to be difficult to provide such an effective sealing. According to another solution, the drive motor may be provided inside the casing. However, this solution requires such an enclosure of the drive motor that oil is prevented from penetrating the drive motor and destroying the latter.

Another problem in this connection is the removal of the heat absorbed by the oil mist during its passage through the bearings, which support the drive shaft of the centrifuge rotor.

SUMMARY OF THE INVENTION

The object of the present invention is to remedy the problems mentioned above and provide a drive unit enabling a satisfactory sealing of the inner space of the casing with respect to the environment and enabling an effective cooling of the oil mist which is re-circulated in the inner space of the casing.

This object is obtained by the drive unit initially defined, which is characterised by a shielding member provided inside the casing in such a manner that the part of the transferring member which is located inside the casing is shielded from the inner space. Despite the fact that a part of the transferring member is located inside the casing, the whole transferring member, for instance in the form of a drive belt, will thus be separated from the inner space defined by the casing. No sealing of the transferring member is thereby required. Furthermore, such a shielding member enables an effective cooling of the different driving components by means of the surrounding air. The shielding member also creates a relatively large cooling surface extending in the inner space of the casing and thus contributes to the cooling of the oil mist, which is re-circulated in the inner space of the casing. Advantageously, the shielding member forms a channel, which extends through the casing and is shielded from the inner space of the casing.

According to an embodiment of the invention, the shielding member includes an upper opening and a lower opening, wherein the drive shaft extends through the shielding member through these openings. Sealing members may thereby be provided between the drive shaft and said openings. Thereby, the interior of the casing may, in an easy manner, be sealed from the environment and oil may be prevented from reaching the environment and the drive belt.

According to a further embodiment of the invention, the shielding member is connected to the casing by a connection extending around said passage. Furthermore, the shielding member may have an elongated shape with a longitudinal axis extending substantially radially with respect to the axis of rotation. The shielding member extends substantially diametrically through the casing with respect to the axis of rotation.

According to a further embodiment of the invention, the transferring member includes a drive belt which engages the drive shaft via a belt pulley provided on the drive shaft and thus located inside the shielding member. Such a drive belt will contribute to the creation of an air flow through the channel, thereby making the cooling more efficient. A wall member may thereby be substantially centrally provided in said channel in such a way that the channel is divided into two partial-channels and the drive belt may run inwardly in one of the partial-channels and outwardly in the other partial-channel. In such a manner, a first air flow from the environment will flow inwardly in one of the partial-channels and a second air flow will flow outwardly through the other partial-channel. The wall member extends in a substantially axial and radial plane with respect to the axis of rotation from an area in the proximity of the belt pulley to an area in the proximity of said passage. The drive shaft may be rotatably journalled in at least one bearing member located radially inside the drive belt.

According to a further embodiment of the invention, the transferring member includes a drive belt which engages the drive shaft via a belt pulley provided on the drive shaft and thus located inside the shielding member. Such a drive belt will contribute to the creation of an air flow through the channel and thereby making the cooling more efficient. Advantageously, a wall member may thereby be substantially centrally provided in said channel in such a way that the channel is divided into two part-channels and the drive belt may run inwardly in one of the part-channels and outwardly in the other part-channel. In such a manner, a first air flow from the environment will flow inwardly in one of the part-channels and a second air flow will flow upwardly through the other part-channel. Advantageously, the wall member extends in a substantially axial and radial plane with respect to the axis of rotation from an area in the proximity of the belt pulley to an area in the proximity of said passage. The drive shaft may be rotatably journalled in at least one bearing member located radially inside the drive belt.

BRIEF DESCRIPTION OF THE DRAWINGS

The present invention is now to be explained more closely by a description of an embodiment and with reference to the drawings attached, in which FIG. 1 discloses schematically a partly sectional perspective view of a drive unit for a centrifuge rotor of a centrifugal separator, and FIG. 2 discloses a sectional view through a lower part of the drive unit in FIG. 1.

DETAILED DESCRIPTION OF THE PREFERRED EMBODIMENTS OF THE INVENTION

Figure 1:
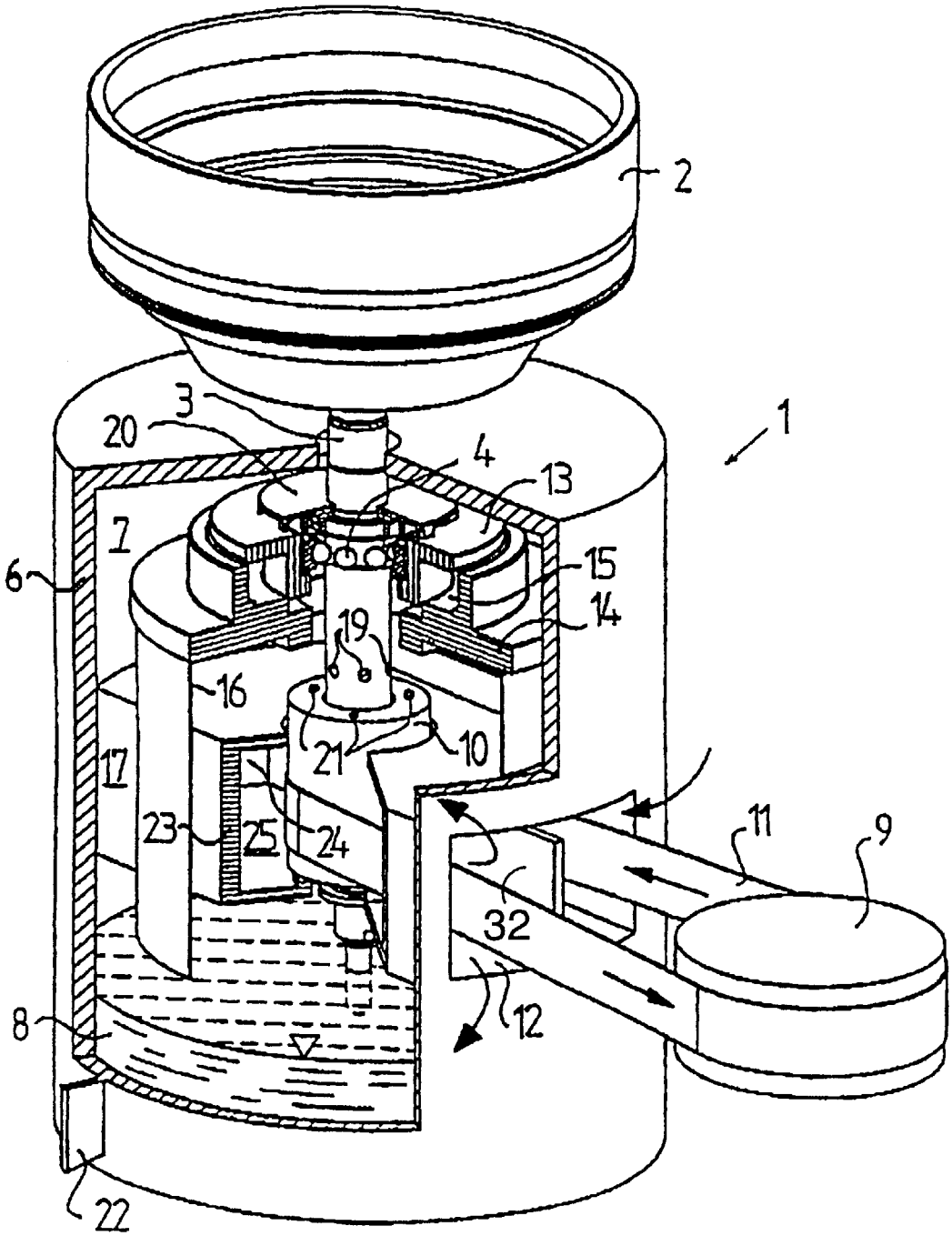

FIG. 1 discloses a drive unit 1 for a partly disclosed centrifuge rotor 2. The drive unit 1 and the centrifuge rotor 2 form together essential components of a centrifugal separator. The drive unit 1 includes a drive shaft 3, which supports the centrifuge rotor 2 and is rotatable around an axis z of rotation and carried by means of a first, upper bearing member 4 and a second, lower bearing member 5, see FIG. 2. Furthermore, the drive unit 1 includes a casing 6 delimiting an inner space. The inner space consists of an upper space 7, in which the drive shaft 3, the first bearing member 4, and the second bearing member 5 are located, as well as a lower space 8, which is designed as an oil sump and arranged to contain a quantity of liquid oil. The drive unit 1 also includes a drive motor (not disclosed) which is connected to a belt pulley 9. The drive motor and the belt pulley 9 are provided outside the casing 6 and connected to a belt pulley 10 fixedly attached to the drive shaft 3 by means of a transferring member in the form of a drive belt 11 extending through a passage 12 in the casing 6. It is to be noted that the drive belt 11 may be replaced by a drive shaft which, via two bearings, drivingly engages the drive motor and the drive shaft 3.

The upper bearing member 4, the so-called neck bearing, is carried by means of the bearing housing 13. The bearing housing 13 is connected to a first shielding member 14 including at least one shielding portion, which extends outwardly, preferably substantially radially outwardly, from the upper bearing member 4 in a direction towards an inner wall of the casing 6. The bearing housing 13 and the shielding member 14 are, in the example disclosed, designed to form a space 15, which is intended to receive dampening elements (not disclosed) known per se. The upper bearing member 4 is connected to the casing 6 via the bearing housing 13, said dampening elements and the first shielding member 14.

A second shielding member 16 extends substantially axially downwardly from a radially outer edge of the first shielding member 14 between the drive shaft 3 and an inner wall of the casing 6 in such a way that an annular passage 17 is formed therebetween. The second shielding member 16 extends in the example disclosed around the drive shaft 3 and so far downwardly that a relatively thin gap is formed between a lower edge of the second shielding member 16 and the oil in the lower space 8.

Figure 2:
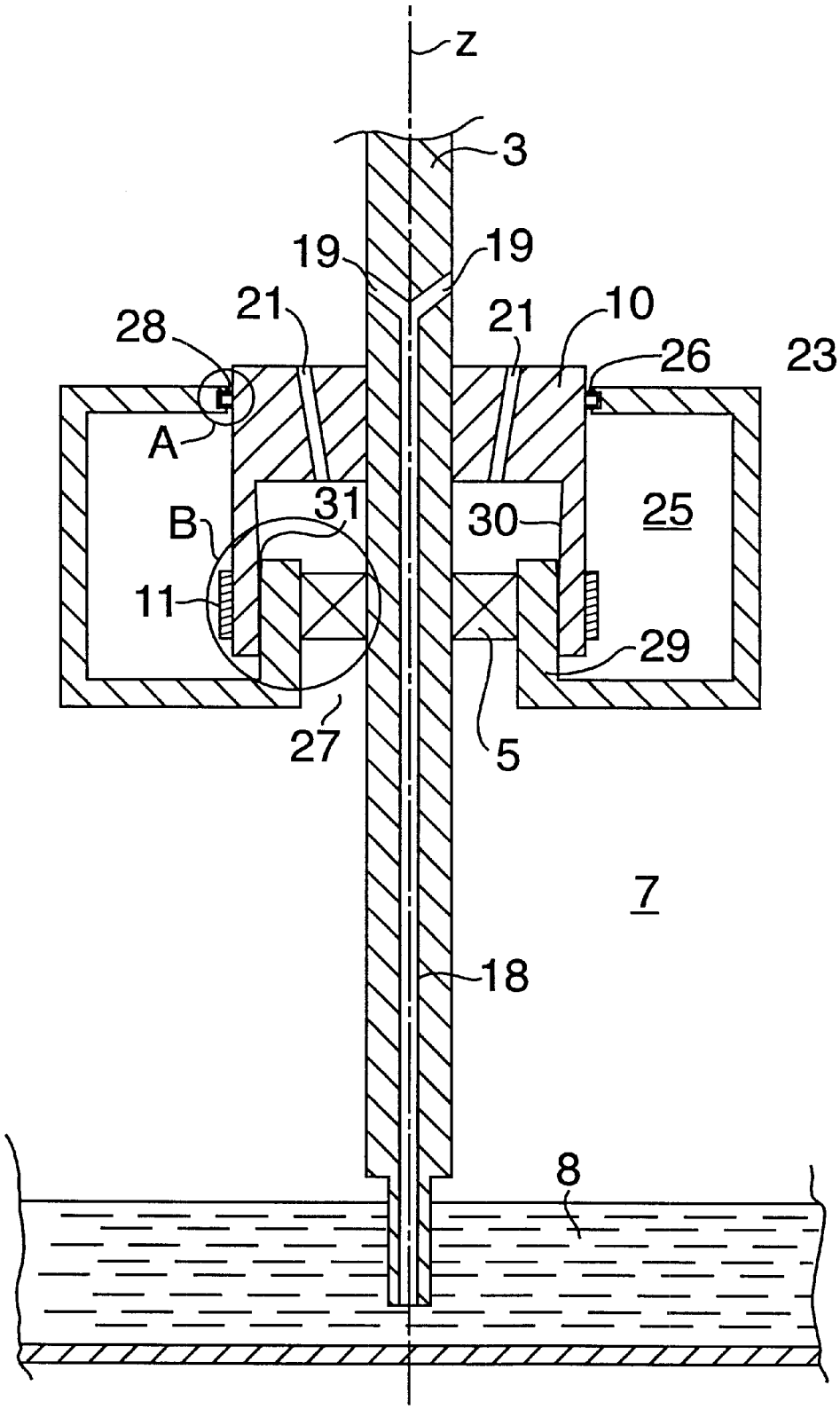
Figure 3:
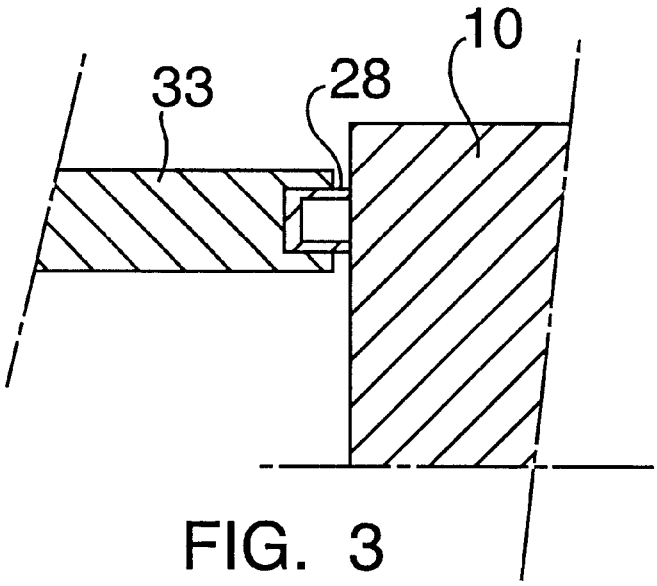
FIG. 3 is an enlarged partial cross-sectional view of the drive unit of FIG. 2 corresponding to the area enclosed by the circle labelled A in FIG. 2.
Figure 4:
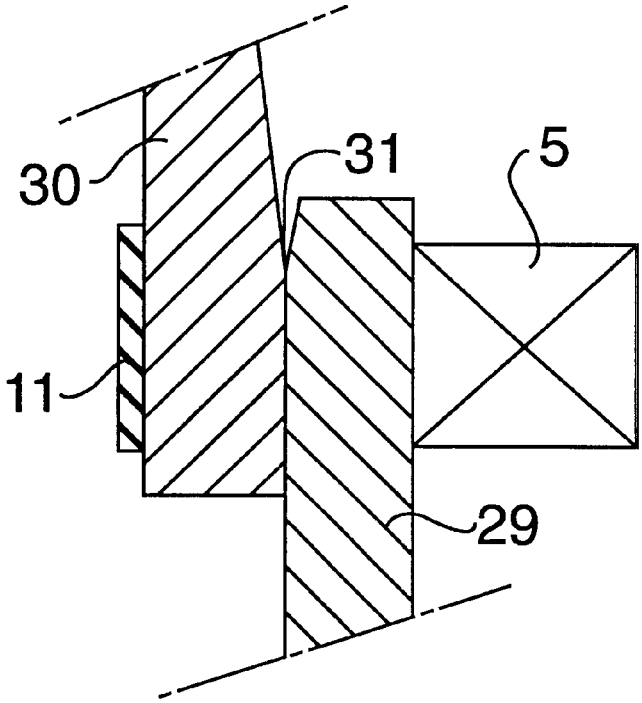
FIG. 4 is an enlarged partial cross-sectional view of the drive unit of FIG. 2 of the area enclosed by the circle labelled B in FIG. 2.

In the example disclosed, the drive shaft 3, see FIG. 2, extends through the upper space 7 and downwardly into the oil in the lower space 8. Furthermore, the drive shaft 3 includes an inner channel 18, which has at least one orifice in the lower space 8 and a plurality of orifices 19 in the upper space 7 above the belt pulley 10 but below the upper bearing member 4. The drive shaft 3 is designed in such a way that oil is transported through the inner channel 18 during operation of the centrifugal separator and forms small oil droplets at least at the exit of the oil from the upper orifices 19.

Furthermore, the drive unit 1 includes a fan wheel 20 which is fixedly provided on the drive shaft 3, in the example disclosed above the upper bearing member 4. The fan wheel 20 is arranged to drive a flow of air and oil droplets, which form an oil mist flowing through the upper bearing member 4 for cooling and lubricating thereof. Furthermore, the fan wheel 20 is arranged to drive said flow from an outlet of the upper bearing member 4 radially outwardly in a direction towards the inner wall of the casing 6 and axially downwardly through the passage 17 between the inner wall of the casing 6 and the second shielding member 16 to a position immediately above the oil in the lower space 8, i.e. to said gap between the second shielding member 16 and the oil in the lower space 8. A part of the oil, which is present in said flow, will thereby be collected by the oil in the lower space 8 and a part of the oil will be transported further by the air stream upwardly through the lower bearing member 5 in such a way that also the latter is cooled and lubricated, which is described more closely below. From an outlet of the lower bearing member 5, the oil mist is transported further through a number of channels 21, which extend through the belt pulley 10, up to an inlet of the upper bearing member 4. An air stream containing oil droplets will thus be re-circulated as an oil mist in a path in the inner space 7, 8 defined by the casing 6, which extends through the upper and lower bearing members 4, 5 and the passage 17 where the oil mist looses its heat and is cooled by contacting the inner wall of the casing 6. In order to increase the cooling of the oil mist, flanges 22 or any similar surface-increasing members may be provided on the outer wall of the casing 6. FIG. 1 discloses as an example one such flange 22. Such flanges or any similar surface-increasing members may also be provided on the inner wall of the casing 6 and/or on the second shielding member 16.

It is to be noted that the passage 17 may be realized in many different manners. For instance, the passage may be formed by conduits extending substantially vertically outside the casing 6 by means of openings in the upper and lower parts of the casing 6. Such external conduits may be cooled in an efficient manner by the air of the environment. The passage may also be formed by channels extending substantially vertically in the wall of the casing 6 from an upper part of the casing 6 to a lower part thereof. In these embodiments, the second axial shielding member 16 may be dispensed with. The passage 6 may also be designed as a number of separate channels extending substantially vertically inside the inner wall of the casing 6. In such an embodiment, the second shielding member 16 may be formed by a plurality of shielding members, for instance a separate shielding member for each such separate channel.

Furthermore, the drive unit 1 includes a shielding member 23, which is provided in such a casing 6 and which is arranged to house the part of the drive belt 11 which extends inside the casing 6 in such a way that the drive belt 11 is shielded from the inner space 7, 8 of the casing 6. The shielding member 23 is connected to the inner wall of the casing 6 at two diametrically opposed sides by means of a respective connection extending around the passage 12 mentioned above and diametrically opposite passage 24. Consequently, the shielding member 23 forms a channel 25 which extends substantially diametrically through the inner space 7, 8 of the casing 6 with respect to the axis z of rotation and which is shielded from this inner space 7, 8. Furthermore, the shielding member 23 has an elongated, box-like shape, i.e. it is substantially rectangular seen in the cross-sectional view disclosed in FIG. 2, and includes an upper limiting wall and a lower limiting wall, which are substantially parallel to each other, and two substantially parallel lateral limiting walls. It is to be noted that the shielding member 23 also may have another cross-sectional shape than a rectangular one, it may, for instance, be oval.

Furthermore, the shielding member 23 includes an upper opening 26, which extends through the upper limiting wall, and a lower opening 27, which extends through the lower limiting wall. The drive shaft 3 extends through the shielding member 23 through these openings 26, 27, wherein the upper opening 26 also is arranged to receive an upper part of the belt pulley 10. As indicated in FIG. 2, a gap seal 28, for instance a labyrinth seal, is provided between the belt pulley 10 and the upper limiting wall of the shielding member 23. The lower limiting wall of the shielding member 23 includes a circular cylindrical portion 29, which forms the lower opening 27. The circular cylindrical portion 29 carries, as appears from FIG. 2, the lower bearing member 5. Furthermore, the circular cylindrical portion 29 extends in a circular cylindrical recess 30 of the belt pulley 10. Between the outer surface of the cylindrical portion 29 and the inner surface of the circular cylindrical recess 30 a gap seal 31 is provided. Furthermore, as appears from FIG. 2, the drive belt 11 abuts the belt pulley 10 substantially radially outside the lower bearing member 5.

The re-circulating air stream with the oil mist may thus pass through the shielding member 23 via the lower opening 27, through the lower bearing member 5 and out through the channels 21 of the upper part of the belt pulley 10. The air stream with the oil mist may however not pass into the channel 25 defined by the shielding member 23 thanks to the sealing arrangements 28 and 31. However, an air stream from the air of the surroundings of the drive unit 1 may pass through the passages 12 and 24 and the channel 25. In such a way, further cooling of the oil mist may be obtained and at the same time, the cooling of the lower bearing member 5 may be improved.

The drive belt 11 disclosed will thereby act as a pump member and contribute to driving such an air stream through the channel 25. The part of the drive belt 11 which runs inwardly in the channel 25 will thereby force an air stream into the channel 25 and the part of the drive belt 11 running outwardly in the channel 25 will force an air stream out of the channel 25. In order to improve the air flow through the channel 25, a wall member 32 is provided substantially centrally in the channel 25 in such a way that the channel 25 is divided into two partial-channels. The wall member 32 extends in a substantially axial and radial plane with respect to the axis z of rotation from an area in the proximity of the belt pulley 10 to an area in the proximity of the passage 12. The drive belt 11 thus runs inwardly in one of the partial-channels and outwardly in the other partial-channel.

It is to be noted that channel 25 does not necessarily need to extend transversely through the inner space 7, 8 defined by the casing 6, i.e. merely one of the passages 12 and 24 is necessary. It is also possible to increase the cooling effect via the shielding member 23 by means of a fan member arranged to increase the air flow through the channel 25.

Furthermore, also the shielding member 23 may be provided with flanges or any similar surface-increasing members, which extend into the channel 25 and/or into the inner space 7, 8 defined by the casing 6.

The present invention is not limited to the embodiment disclosed but may be varied and modified within the scope of the following claims.

What is claimed is:

1. A drive unit (1) for a centrifuge rotor (2) of a centrifugal separator, comprising a drive shaft (3), arranged to support said centrifuge rotor (2) and rotatably journalled around an axis (z) of rotation, a casing (6), which forms an inner space for the drive shaft (3), a drive motor shaft (9) which is provided outside the casing (6) and connected to the drive shaft (3) by means of a transferring member (11) extending through a first passage (12) in the casing (6), at least one shielding member (23), which is provided inside the casing (6) in such a manner that the part of the transferring member (11) which is located inside the casing (6) is shielded from the inner space, and wherein the shielding member (23) forms a channel (25), which extends through the casing (6) and is shielded from the inner space of the casing (6); and wherein the shielding member (23) includes an upper opening (26) and a lower opening (27), and the drive shaft (3) extends through the shielding member (23) through the upper and lower openings (26, 27); and wherein sealing member (28, 31) are provided between the drive shaft (3) and said upper and lower openings (26, 27).

2. A drive unit according to claim 1 wherein the shielding member is connected to the casing.

3. A drive unit according to claim 1 wherein the shielding member (23) has an elongated shape with a longitudinal axis, which extends substantially radially with respect to the axis (z) of rotation.

4. A drive unit according to claim 1 wherein the shielding member (23) extends substantially diametrically through the casing (6) with respect to the axis (z) of rotation.

5. A drive unit according to claim 4, wherein the drive shaft (3) is rotatably journalled in at least one bearing member (5), which is located radially inside the transferring member (11).

6. A drive unit according to claim 1 wherein the transferring member includes a drive belt (11) which engages the drive shaft (3) via a belt pulley (10), which is provided on the drive shaft and thus is located inside the shielding member (23).

7. A drive unit (1) for a centrifuge rotor (2) of a centrifugal separator, comprising a drive shaft (3), arranged to support said centrifuge rotor (2) and rotatably journalled around an axis (z) of rotation, a casing (6), which forms an inner space for the drive shaft (3), a drive motor shaft (9) which is provided outside the casing (6) and connected to the drive shaft (3) by means of a transferring member (11) extending through a first passage (12) in the casing (6), at least one shielding member (23), which is provided inside the casing (6) in such a manner that the part of the transferring member (11) which is located inside the casing (6) is shielded from the inner space, and wherein the shielding member (23) forms a channel (25), which extends through the casing (6) and is shielded from the inner space of the casing (6);

wherein the casing (6) includes a second passage (24) diametrically opposite to the first passage (12), and wherein the shielding member (23) extends between the two passages (12, 24) in such a way that the channel 25) extends through the casing (6).

8. A drive unit for a centrifuge rotor (2) of a centrifugal separator, comprising a drive shaft (3), arranged to support said centrifuge rotor (2) and rotatably journalled around an axis (z) of rotation, a casing (6), which forms an inner space for the drive shaft (3), a drive motor shaft (9) which is provided outside the casing (6) and connected to the drive shaft (3) by means of a transferring member (11) extending through a first passage (12) in the casing (6), at least one shielding member (23), which is provided inside the casing (6) in such a manner that the part of the transferring member (11) which is located inside the casing (6) is shielded from the inner space, and wherein the shielding member (23) forms a channel (25), which extends through the casing (6) and is shielded from the inner space of the casing (6);

wherein the transferring member includes a drive belt (11) which engages the drive shaft (3) via a belt pulley (10), which is provided on the drive shaft and thus is located inside the shielding member (23);

wherein the drive unit further includes a wall member (32), which is substantially centrally provided in said channel (25) in such a manner that the channel is divided into two partial-channels and that the drive belt (11) runs inwardly in one of the partial-channels and outwardly in the other partial-channel.

9. A drive unit according to claim 8, wherein the wall member (32) extends in a substantially axial and radial plane with respect to the axis (z) of rotation from an area in the proximity of the belt pulley (10) to an area in the proximity of said passage (12).

* * * * *